United States Patent [19]

Ernest

[11] Patent Number: 4,816,103

[45] Date of Patent: Mar. 28, 1989

[54] PROCESS FOR MANUFACTURING CORRUGATED PLYWOOD COMPOSITES

[76] Inventor: Ethan Ernest, 257 W. 19th St., New York, N.Y. 10011

[21] Appl. No.: 40,640

[22] Filed: Apr. 21, 1987

[51] Int. Cl.[4] ..... B31F 1/22

[52] U.S. Cl. ..... 156/205; 100/202; 100/269 A; 144/256.3; 156/274.8; 156/275.5; 156/323; 156/481; 156/583.9; 425/396

[58] Field of Search ..... 156/205, 206, 583.1, 156/583.8, 583.9, 583.91, 581, 481, 470–473, 323, 274.4, 275.5; 425/369, 396, 398; 100/237, 202, 93 P, 269 A; 144/256.3, 256.4

[56] References Cited

U.S. PATENT DOCUMENTS

| | | | |
|---|---|---|---|
| 1,488,504 | 4/1924 | Keyes | 156/206 |
| 1,794,435 | 3/1931 | Barth | 156/205 |
| 2,660,548 | 11/1953 | Soehner | 156/323 |
| 2,764,193 | 9/1956 | Knowles | 156/205 |
| 2,766,787 | 10/1956 | Knowles | 100/237 |
| 2,785,717 | 3/1957 | Knowles | 156/205 |
| 2,990,309 | 6/1961 | Wahl et al. | 156/289 |
| 3,130,761 | 4/1964 | Fleming et al. | 144/256.4 |
| 3,507,733 | 4/1970 | Davidson | 156/323 |
| 4,327,366 | 4/1982 | Schafter et al. | 346/136 |
| 4,334,850 | 6/1982 | Garabedian | 425/388 |
| 4,436,478 | 3/1984 | Allen et al. | 425/305.1 |
| 4,495,019 | 1/1985 | Ogg | 144/256.3 |
| 4,518,550 | 3/1985 | Miettinen et al. | 264/46.5 |
| 4,547,255 | 10/1985 | Yow | 156/583.8 |

*Primary Examiner*—David Simmons
*Assistant Examiner*—David Herb
*Attorney, Agent, or Firm*—Howard C. Miskin

[57] ABSTRACT

A method and apparatus for forming corrugated plywood composites is disclosed. The apparatus includes a fixed mold component having a corrugated surface and a series of movable mold components having complemental corrugated surfaces movable toward and away from the fixed surface. Movable mold components are hingedly in connected and each such component is associated with a linear motor. By sequentially activating the linear motors each movable mold section is pivotally advanced in a first direction toward the fixed mold component the opposite side of the movable mold component being pivoted toward the fixed mold component when the next adjacent section is advanced into clamping position. High tensile strength low coefficient of friction fabric webs are interposed between the surfaces of the mold and the composite material to be corrugated.

4 Claims, 8 Drawing Sheets

PROCESS FOR MANUFACTURING CORRUGATED PLYWOOD COMPOSITES

This invention relates to both the process and apparatus for manufacturing a Corrugated Wood/Composite Panel and the resultant product itself.

In most processes for molding plywood, curves are formed by pressing wooden veneers between two matching mold halves which form a cavity in the shape of the desired curve. This desired shape is retained by curing the glue line between the plies while they are clamped in this mold cavity. This is a typical technique for molding plywood into simple curves. However, when pressing and bonding wooden plies and other lamenae to such extremes as multiple corrugations, the plies cannot adapt themselves to the mold before being exposed to the pressure, upon which they would have to endure very high tensile loads while straining to fill out the corrugations of the mold. These extreme tensile stresses encountered by the plies would certainly cause damage or failure of the veneer and render the product worthless.

Heretofore, prior art processes for the molding of wood plies into corrugations so as to form corrugated plywood have suffered from many drawbacks as a result of their attempts to overcome the natural tendency for the wood to fracture during the molding process, among them:

a. Ineffective stress relieving cauls.

b. Exceedingly complicated machinery which significantly deviates from standard plywood pressing operations therefore inhibiting its acceptance into the existing plywood manufacturing environment.

c. Overly complicated corrugating molds and/or mold assemblies with one or more of the following drawbacks:

i. Inability to accommodate variations in material thicknesses.

ii. Intrinsically expensive.

iii. Difficult to maintain especially when containing liquid heating and/or cooling elements.

iv. difficult or impossible to substitute with molds of varied sizes.

v. not coated with nonstick surfaces.

d. Acceptance of the tensile fracturing of the veneer as elemental to their process and/or product e. High process and/or curing temperatures over 180° F.

f. Ineffecient process heating resulting in wasted energy.

g. High pressing pressures of over 120 psi.

h. Corrugated plywood with the wood sandwiched between layers of 'kraft paper'.

It is an object of the invention to provide flourocarbon/fiberglass as a combination stress relieving caul, lubricant and spacer Another object of the invention is to provide flourocarbon impregnated fiberglass fabric, used as both a lubricating mold liner and a stress relieving caul and a lubricant for the veneer laminae sandwich. The laminae sandwich, hereinafter referred to as "the sandwich", being the stack of veneer plies or other laminae in the loose, uncured, unmolded state as they begin the pressing process. This fabric with its great tensile strength absorbs most of the tensile stress endured by the laminae sandwich during the molding process. Also, because of its extremely low coefficient of friction flourocarbon impregnated fiberglass fabric lubricates the flow of the sandwich into the mold cavity. For this same reason, glue buildup is avoided and the fabric can be utilized repeatedly in a production environment.

To facilitate the entry of the sandwich into the mold cavity, pressure is applied gradually and in a progressive sequence across the mold. The pressure may begin on one side and progress to the opposite. Alternatively, the pressure may begin in the center and proceed outwards. Either sequence may repeat, going backwards again after first achieving partial closure of the mold sections This 'tweaking' will seat the sandwich completely into the mold cavity. The sequence used depends on the type, thickness and quantity of laminae in the sandwich. In some cases no 'tweaking' will be necessary, in other cases it might be done several times in order to properly seat the mold. A determination of which sequencing to use shall be made empirically at the time of pressing with actual samples of the material to be pressed.

A further feature of this invention is the use of a hinged mold in conjunction with a novel sectional press heads which, enhances Sequential Articulated Pressure application. The upper half of the mold is hinged in a multitude of locations. The number of pivots is directly proportional to the ratio of the length of any mold across the corrugations to the amplitude of the corrugation.

A complete self contained press actuator which may be installed in any press structure designed for pressing conventional flat plywood sheets which posesses both bed area and 'daylight' large enough to accommodate the installation of an apparatus of the present invention. The existing press frame may be of the 'fixed daylight' or 'adjustable daylight' variety, 'Fixed daylight' indicating a fixed or non-adjustable opening between the bed platen and its top platen and 'Adujstable daylight' indicating the ability to adjust the distance between the bed platen and top platen.

A further feature of the present invention is in the simplicity of the molds. Fabricated out of conventional plywood, they do not contain internal pipes or conduits for cooling or heating, rather the heating elements are laminated close to the surface of the mold whereby just the plies being laminated are heated not the entire mold. The result is that the curing stage is more energy efficient.

In addition the outer most surface of the mold is laminated with a flourocarbon impregnated fiberglass fabric which renders the mold surface both slippery and completely resistant to excess glue buildup.

By way of a further object of this invention, conductive graphite fabric may be substituted for the flourocarbon/fiberglass fabric used both a stress relieving flexible caul, lubricant and spacer, but with the additional function of providing an electrically conductive surface to enable the use of inductive heating of the plies. This would reduce the adhesive curing time from minutes to a matter of seconds.

Further objects and advantages of my invention will become apparent from a consideration of the drawings and ensuing description thereof.

GENERAL DESCRIPTION OF THE PREFERRED EMBODIMENTS

Descriptions of the physical structure

The Press Heads

Figure 1:
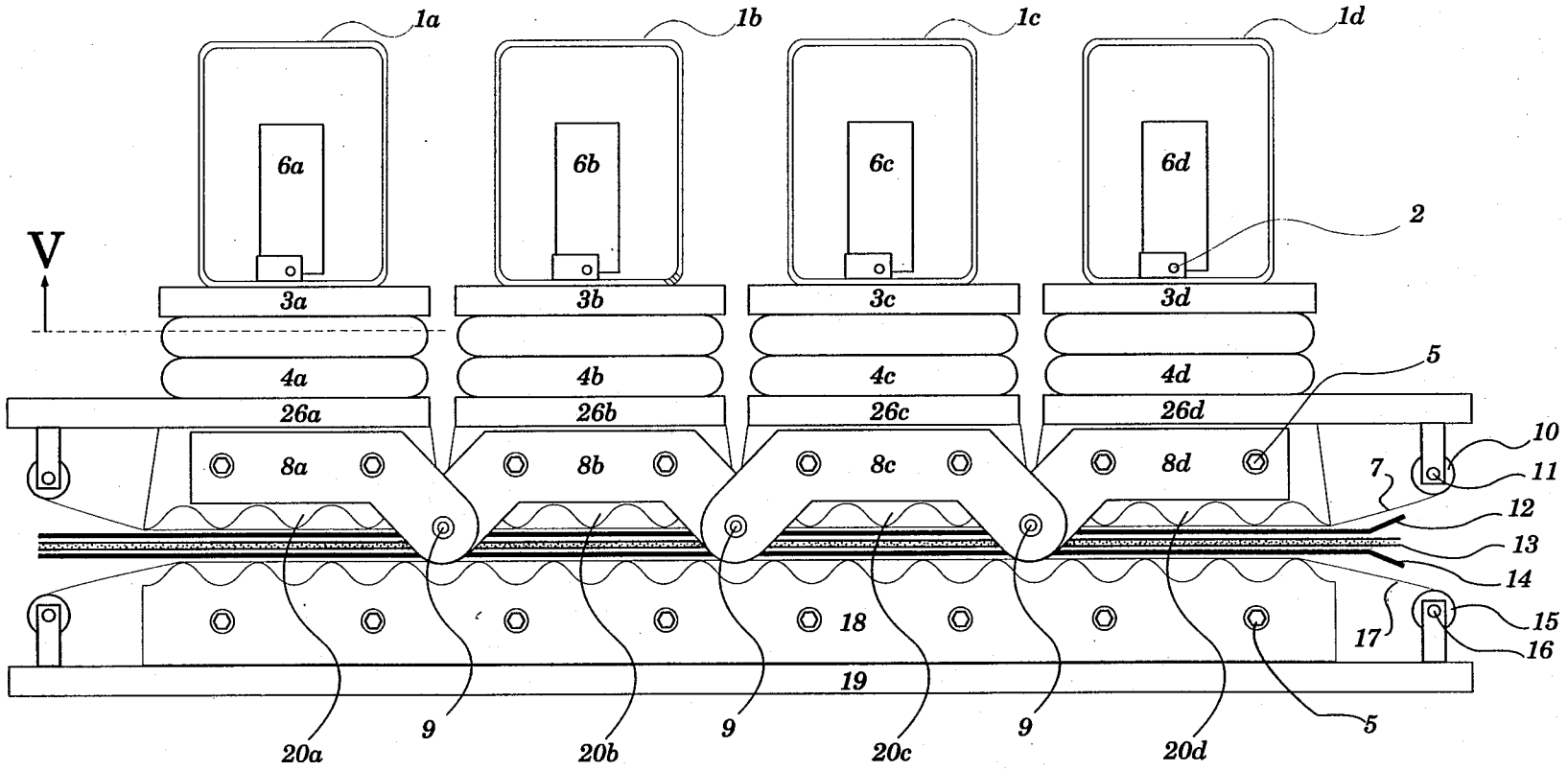
FIG. 1 is an elevation showing all the major components of the pressing mechanism and molds.

Referring to the drawings, structural steel tube 1, houses the (hydraulic or pneumatic) mold retracting cylinders 6 , which are fastened to the structural steel tube 1 and the upper pressure platen 3, on pivoting blocks 2. The retraction cylinders 6, may be of any commercially available type having sufficient piston stroke to allow full retraction and extension of the double convoluted pneumatic actuators 4. The double convoluted pneumatic actuators 4 , provide the main pressure for this molding process and are also widely available (Firestone, Goodyear or equivalent). The retraction cylinders 6 should be of the double acting variety, with the port through which fluid pressure, which normally would provide downward motion of its piston, either opened to the atmosphere(pneumatic) or bled to a resevoir (hydraulic). Retraction cylinders 6 are mounted to both structural tube 1 and the upper pressure platen 3 with socket-headed cap screws, 36. The double convoluted pneumatic actuators 4 are mounted to the structural steel tube 1 through the upper pressure platen 3 with socket-headed cap screws, 39 through mounting holes 27. A lower pressure platen 26, is fastened to the bottom mounting plates of the double convoluted pneumatic actuators 4 with flat headed cap screws 40. Reference numeral 28 indicates the location of the air inlet for the double convoluted pneumatic actuators 4.

Figure 4C:
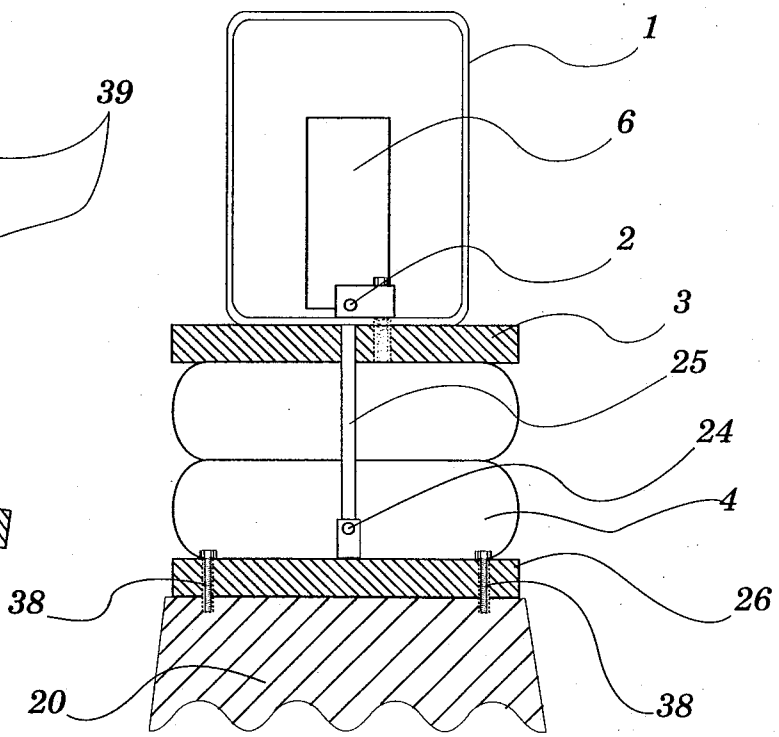
FIG. 4 illustrates a detailed section of the press head actuators taken along line IV in FIG. 3. Three positional states of the same section are illustrated; a fully retracted, b partially extended with an angular displacement and c. fully extended.
Figure 4B:
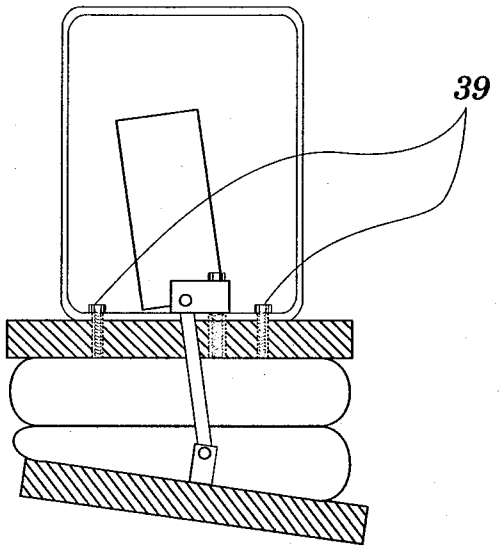
Figure 4A:
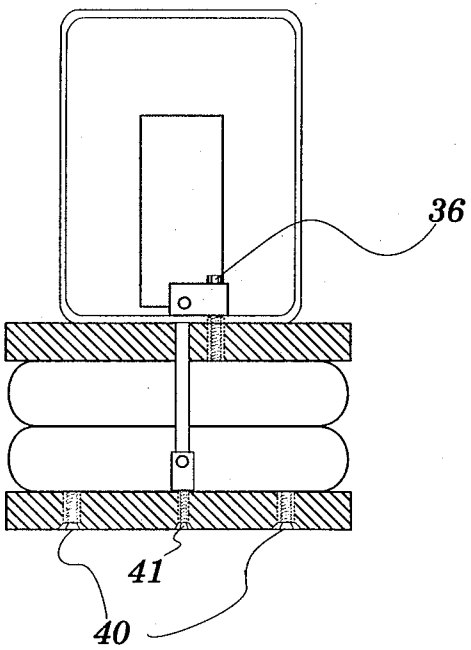

The piston rods 25 of the retraction cylinders 6 pass through slots 29 milled through both the structural steel tube 1, and the upper pressure platen 3. and are fastened to clevises 24 which in turn are fastened to the lower pressur platens 26 by means of a flat headed cap screws 41. The slots 29 together with the clevis attachements 24, enable the press head assembly to pivot as illustrated in FIG. 4.

Mold Construction, geometry and adjustments

The upper and lower corrugated mold platens 18 and 20, can be made of any suitable material, though we've had particular success with A/A Exterior grade plywood, both because of its availability and the ease with which it is machined. The molds are made up of numerous 1" thick sections, each shaped with the curves of the desired corrugation. Each section has clearance holes drilled where the bolts 22 will be located. When the ¾" pieces are assembled they create a corrugated mold section of any desired length parallel to the corrugations. Each mold section may then be covered with either resilient silicone rubber 30 or a resilient silicone rubber resistance heater 32. The mold sections are then covered with a layer of flourocarbon impregnated fiberglass fabric 31 which then forms the outer most layer of the mold section.

Presently we've covered our upper mold section with resilient silicone rubber 30 and the lower section with a resilient silicone rubber resistance heater 32. The silicone rubber resistance heaters 32 provide heat which cures the glue lines between the veneer and other lamina, 12,13,14, when they are pressed into the mold cavity 34,35, thus creating a cohesive corrugated composite panel 42.

The curve which forms the corrugations of the mold section will be such that a cavity 34,35 is created when an identical corrugated mold section is flipped 180° over the vertical axis when viewing the mold as in FIG. 10 and the corresponding 'peak' of the top mold section is located laterally above the corresponding 'valley' of the bottom mold section. The size of the cavity created by any given mold section corresponds with the outer limit of the thickness for panels which can be formed in that mold section. Panels of less thickness then the outer limit can be formed with the addition of spacer material 7,17 introduced into the mold along with the plies being laminated. Without the addition of spacer material an inferior panel would result. If too little material is introduced into the mold and the mold sections are brought within close proximity of each other during a pressing cycle, as illustrated in FIG. **10*c*, no matter how much pressure is applied, the area around cavity 34*c* will always recieve greater pressure than the area around cavity 35*c*. Conversely, if too much material is introduced into the mold, no matter how much pressure is applied, the area around cavity 35*b* will always recieve greater pressure than the area around cavity 34*b***. In either case, uneven pressure of any sort is anathematic in the business of molding curved plywood.

Up to a limit, material thickness variations will be negated by the resilience of the silicone rubber elements 30,32. In practice it is necessary to design a mold with a cavity 34,35, that falls somewhere between the minimum and maximum desired panel thickness. This provides one with the leeway to either add or subtract spacer material 7,17 as the situation dictates. Wood veneers are a natural product with limited dimensional stability, especially when subject to changes in the relative humidity. Any process which claims to have solved all the difficulties of molding wood veneers into corrugated plywood mus effectively address the problem of quickly and simply compensating for material thickness variations.

In the present invention, our preferred embodiment addresses the creation of a 3 ply corrugated plywood with the outer plies 12,14 being wood veneer of each approximately 40 mils thick, with the grain generally running parallel to the corrugations and the core ply being a 20 mil thick calendered aramid paper 13 ( Trade name NOMEX( from Dupont). As such we have optimized our mold cavity 34,35 to 120 mils, for the purpose of pressing these laminae, 12,13,14.

Stress Relieving Caul, Lubricant and Spacer assembly or "window shades".

As indicated in the drawings and alluded to in the preceeding specification, a means by which a stress relieving caul, lubricant and spacer material 7,17 is introduced into the mold cavity along with the veneer plies and other laminal to be molded,12,13,14 is provided by take up rollers, 10,15 and spring loaded mechanisms 11,16. In the present invention 10,11 and 15,16 are mounted on the undersides of lower pressure platens 26*a,*26*d* and the bottom bed platen 19 respectively, where they extend substantially away from the ends of the upper and lower corrugated mold platens 18,20. Both sets of take up rollers and spring loaded mechanisms 10,11 and 15,16 are duplicated on the opposite side of the press as seen in FIG. 1. In function and in actuality, 10,11,15,16 are 'window shade' rollers with spring loaded mechanisms, each pulling the stress relieving caul, lubricant and spacer material 7,17 laterally away from the center of the press when viewed in FIG. 1. As such they also provide a means by which the stress relieving caul, lubricant and spacer material 7,17 may be taken back up after the molding process is complete.

For the proper functioning of the press and all its embodiments, these parts 10,11,15,16, are not necessary. The flourocarbon impregnated fiberglass sheets may be simply fed into the mold cavity prior to pressing along with the other laminae 12,13,14 as part of the 'sandwich', by hand. However they provide an effective way to eliminate some of the cumbersome aspects of feeding so many elements into the press. They also enhance the acceptability of the machinery into the existing plywood manufacturing environment by providing a way to just feed the plies which are being pressed 12,13,14 into the mold, and subsequently removing the same without having to deal with the spacer materials at all. It is anticipated that high-production versions of this process will use more sophisticated roller takeup mechanisms than window shades, however the principle of their operation will remain the same.

The upper hinged mold platen assembly

Figure 3:
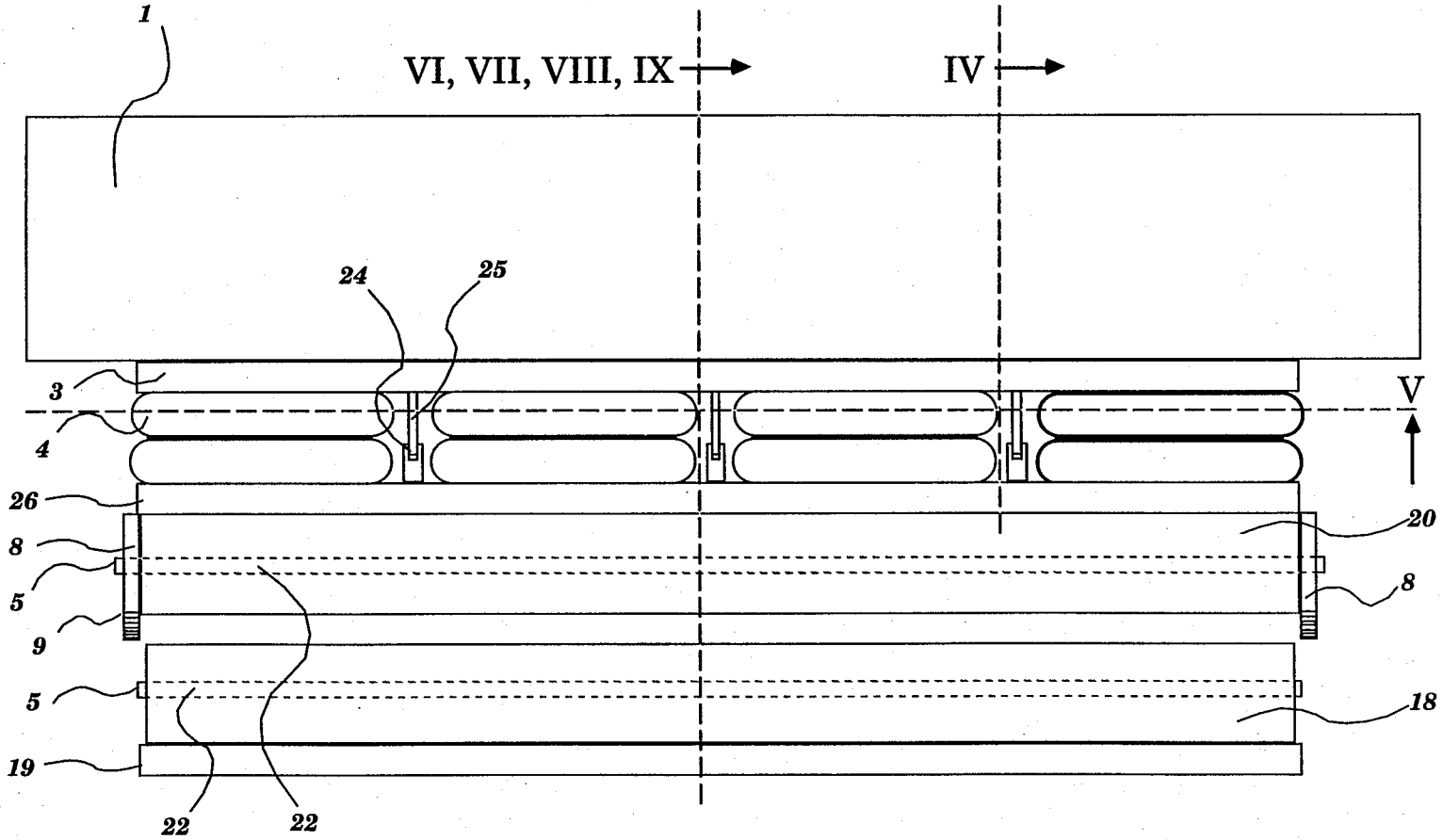
FIG. 3 is an and elevation of the pressing mechanism shown in FIG. 1.

The upper hinged mold platen assembly is composed of upper corrugated mold platens 20*a,b,c,d,* each with trunnion hinges on links 8*a,b,c,d* respectively fastened on either side. Each hinge 8 is attached to its respective upper corrugated mold platen 20 by means of threaded bolts 22 which run through the whole upper corrugated mold platen 20 and a hinge 8 on both sides (see FIG. 3), and are secured by threaded nuts 5. The trunnion hinges are designed so that bushings 9*a,b,c,* about which they pivot are centered over the apexes 21 of adjacent upper corrugated mold platens 20, when they are fastened to their respective corrugated mold sections and located by the threaded bolts 22. The net result of this fastening is that the hinges 8 hold together all of the upper corrugated mold platens 20 so that they will pivot about their apexes, 21. An analogy would be that the mold sections are connected much like the links of a bicycle chain are connected.

Figure 5:
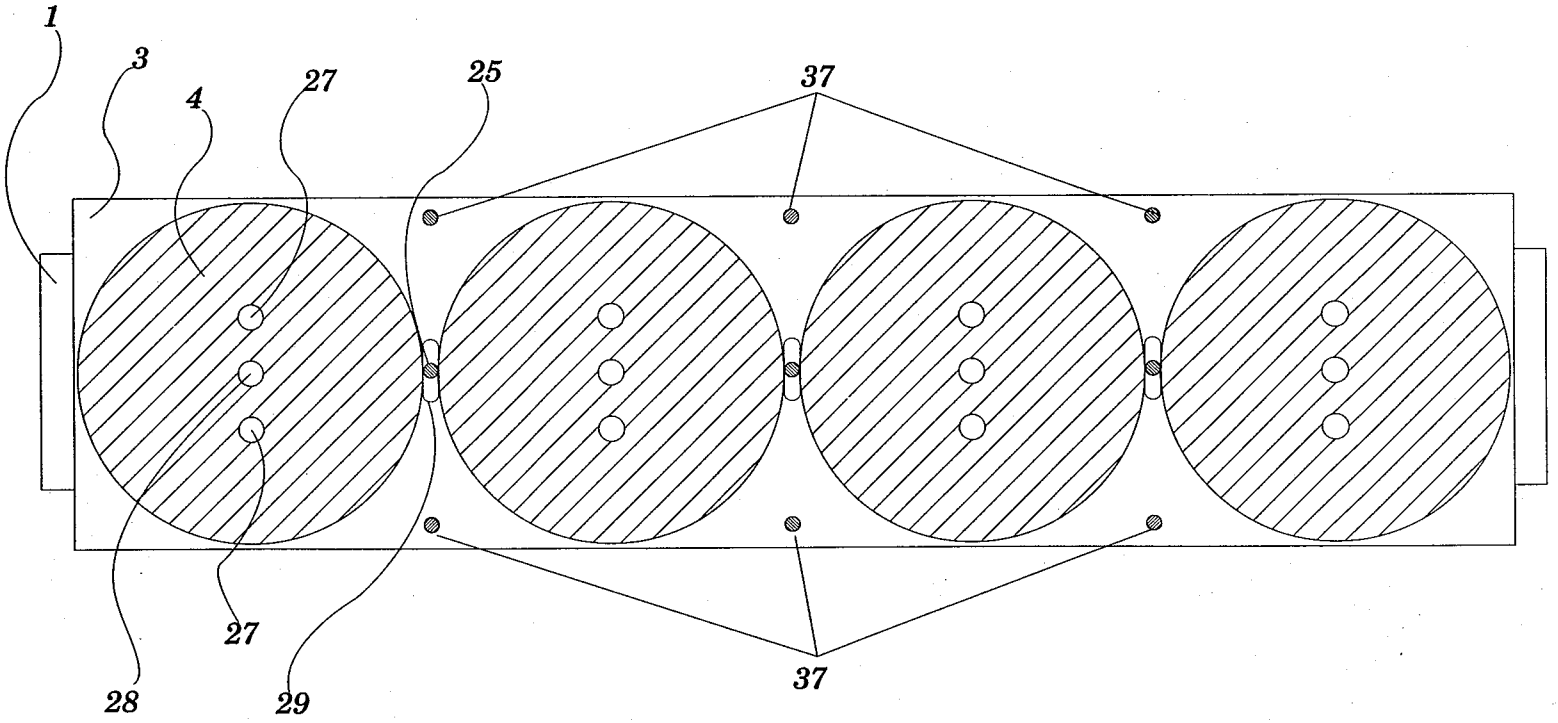
FIG. 5 is a sectional plan through the press head assembly taken along section line V in FIG. 1.
Figure 7:
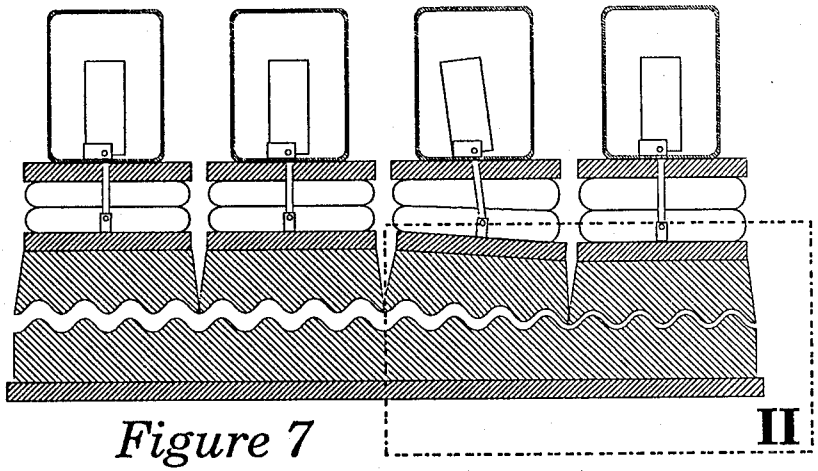
FIGS. 6 through 9 are sectional elevations taken along lines VI to IX in FIG. 3 illustrating the Sequential Articulated Pressure.
Figure 6:
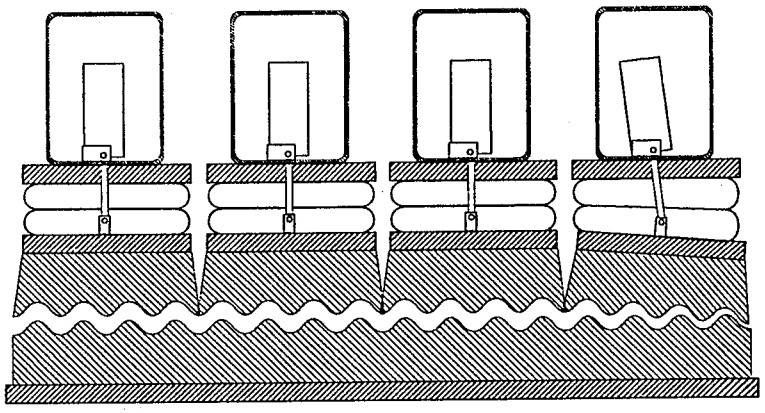
Figure 9:
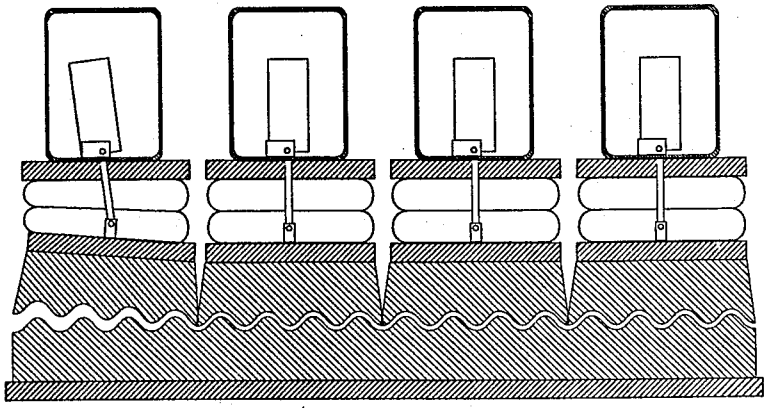
Figure 8:
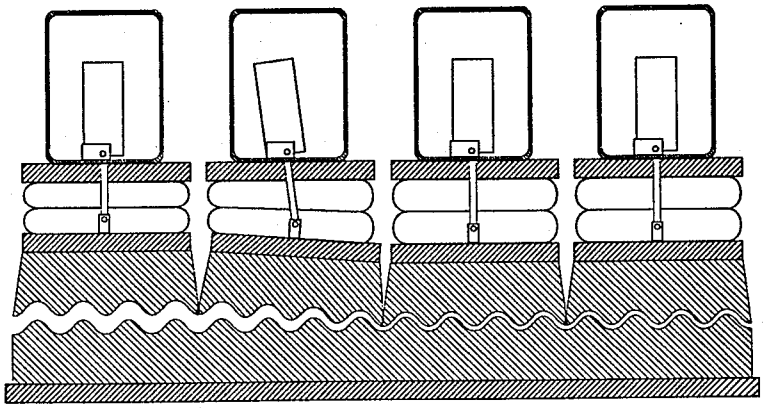

Each section of the upper hinged corrugated mold platen assembly 20 together with hinged links 8 is then fastened to the lower pressure platens 26 by means of a easily demountable socket headed cap screws 38, located at positions 37 (see FIG. 5 ). This type of attachment renders the mold assembly easily replaceable with alternate mold shapes.

Lower mold assembly and bed

The lower mold platen 18 is quite similar in construction to the upper corrugated mold platen 20 with the simple exception that it is assembled as one contiguous piece with no hinges. It rests on the bottom bed platen 19.

Combined Overall Assembly and S.A.P.A.

When all of the above specifications are taken together as a whole, the resultant piece of machinery as illustrated in FIG. 1 can be considered as a complete Sequential Articulated Pressure Actuator with mold. As such it may be placed in any existing press frame or existing plywood laminating press so that the bottom bed platen 19 would be securely fastened to the bed of the existing press structure and mounted directly above it the rest of the Sequential Articulated Pressure Actuator with mold would be fastened to the upper platen or structure of the existing press through the rectangular structural steel tubes 1.

This adaptation may be accomplished with any press structure designed for pressing conventional flat plywood sheets which posesses both bed area and 'daylight' large enough to accomodate the installation of the present invention. The existing press frame may be of the 'fixed daylight' or 'adjustable daylight' variety, 'Fixed daylight' indicating a fixed or non-adjustable opening between the bed platen and its top platen and 'Adjustable daylight' indicating the ability to adjust the distance between the bed platen and top platen.

Operations

In this process for molding plywood, corrugated is formed by pressing wood veneer plies between two matching mold halves 8,18 which form a cavity 34,35 in the shape of the desired sinesoidal corrugation. The desired shape is retained by curing the glue line between the laminae while they are clamped in this mold cavity.

This is a typical technique for molding plywood into simple curves. However, when pressing wood veneer to such extremes as corrugations, the extreme tensile stresses encountered by the laminae would certainly cause damage or failure of the veneer under tensile load. The combination of and improvements to three embodiments of past art are necessary and integral to this novel molding process. They are:

1. Flourocarbon impregnated fiberglass fabric is used as a stress relieving caul, lubricant, and spacer material.

Figure 2:
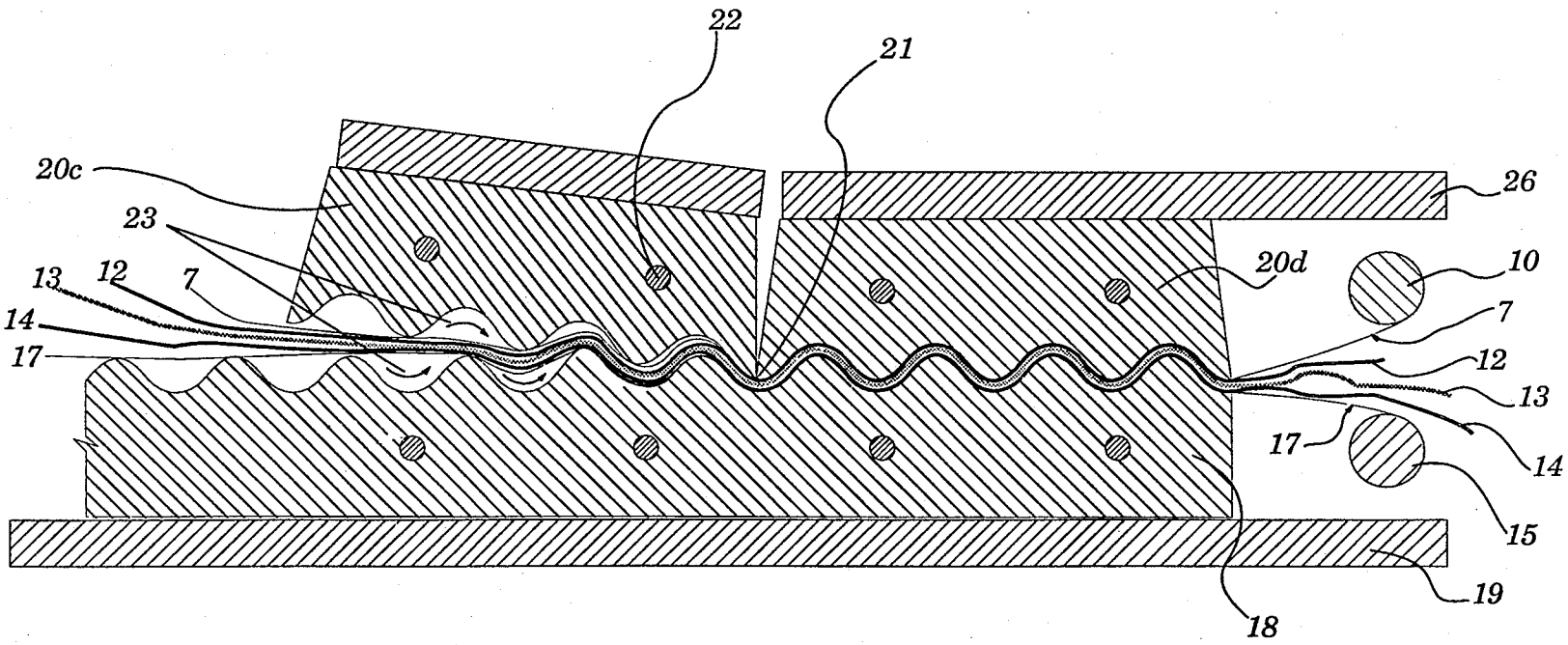
FIG. 2 is a detailed section in elevation of the area surrounded by the dotted lines indicated in FIG. 7.

Flourocarbon impregnated fiberglass fabric, is used as both a lubricating mold liner 12,14, and as a stress relieving caul for the veneer laminae sandwich 12,13,14, The laminae sandwich, hereinafter referred to as "the sandwich", is the stack of veneers 12,14, and/or other laminal 13, in the loose, glue appled but uncured, in an unmolded state as they begin the pressing process Flourocarbon impregnated fiberglass fabric with its great tensile strength absorbs almost all of the tensile strain endured by the laminae sandwich during the molding process. Also, because of its extremely low coefficient of friction, flourocarbon impregnated fiberglass fabric lubricates the flow of the sandwich into the mold cavity 23 as seen in FIG. 2. For this same reason, glue buildup is avoided and the fabric can be utilized repeatedly in a production environment.

A minimum of four layers of flourocarbon impregnated fiberglass fabric are typically employed. Two layers 31, are permanently adhered to the curved faces of the mold halves, two more 7,17, compose the outer layers of the sandwich. These two layers of fabric can either enter the press with the sandwich or be mounted more permanently with the mold assembly. 'Window shade' type rollers 10,11,15,16, take up the slack when the mold is in the open position yet release the fabric gradually into the mold cavities as the mold closes. It is anticipated that high-production versions of this mold assembly will use more sophisticated roller take-up mechanisms than window shades, however the principle will remain the same.

Figure 10D:
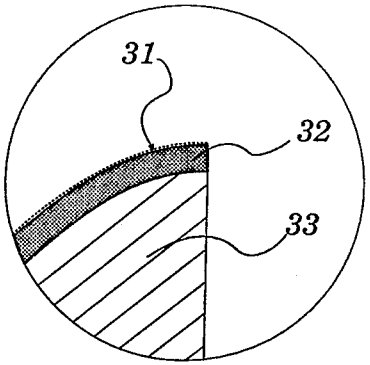
FIG. 10 illustrates sectional elevations taken from any part of the the mold. Four views of the same illustrate the following particulars; a the mold halves with an optimum cavity between them, b the mold halves with an excessive cavity between them, c the mold halves with an deficient cavity between them, d a closeup showing material composition of the mold halves.
Figure 10C:
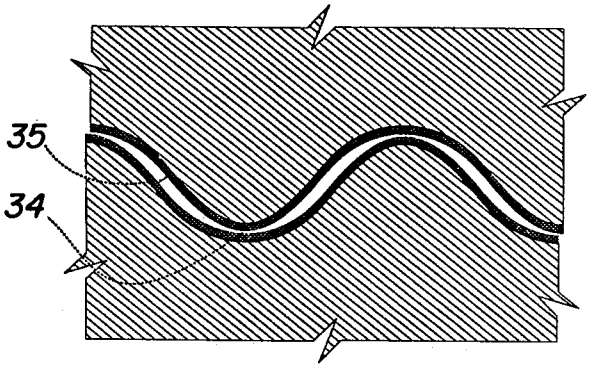
Figure 10A:
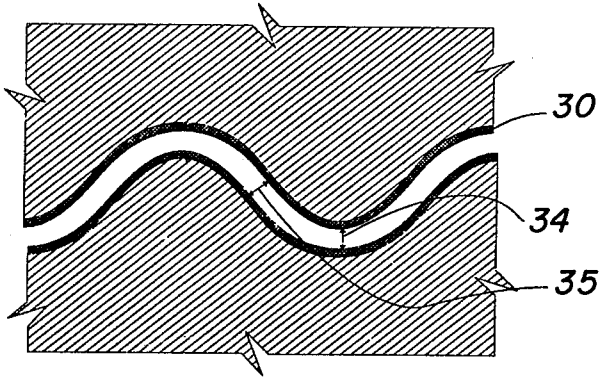
Figure 10B:
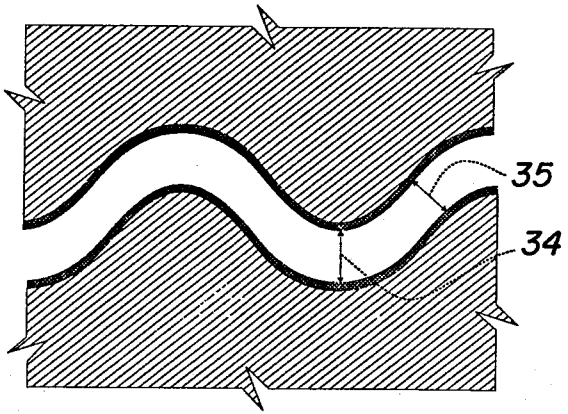

In some cases it is advantageous to use additional layers of flourocarbon impregnated fiberglass fabric as a 'spacer' material.

a. When attempting to corrugate particularly delicate or thin veneers or other laminates, the use of additional layers of flourocarbon impregnated fiberglass fabric can provide further tensile strain relief and lubrication. Because delicate veneers tend to also be thinner, the additional layers of flourocarbon impregnated fiberglass fabric can also serve a function as 'spacer' material:

b. Unlike molding flat panels, where the same two press platens can mold any number of different panel thicknesses, the cavity 34,35 of any given set of corrugating mold platens dictates the total panel thickness which can be pressed between them. If too much or too little material in the sandwich is pressed between the platens, the result is uneven pressure distribution in the mold (FIGS. 10*b,c*).

When variations in veneer thickness among different supplies or species become apparent, 'spacer' material must be added or removed, in order to maintain the proper thickness for a given set of corrugating mold platens. In practice a mold will be made with a cavity equal to the dimension of the desired panel thickness.

If slightly thinner veneers are then used, the mold thickness requirement can be accommodated by adding flourocarbon impregnated fiberglass fabric 'spacers'. If slightly thicker veneers are encountered, then the resilience of the rubber will make up the difference. In either case, if the discrepancies are too large, a new mold will be required to accommodate the new thickness range.

My experience has shown that 10 mil thick flourocarbon impregnated fiberglass fabric used as a mold liner has shown no deterioration at all after 100 press cycles. 10 mil thick flourocarbon impregnated fiberglass fabric when used as the tensile strain relieving caul, has shown some degradation, however; it can simply and economically be replaced weekly as part of routine maintenance for the press.

2. Sequential Articulated Pressure (SAP)

To facilitate the entry of the sandwich into the mold cavity, pressure is applied gradually and in a progressive sequence across the mold (FIGS. 6,7,8,9). The pressure may begin on one side and progress to the opposite. Alternatively, the pressure begins in the center and proceed outwards. Either sequence may repeat, going backwards again after first achieving partial closure of the mold sections. This 'tweaking' will seat the sandwich completely into the mold cavity. The sequence used depends on the type, thickness and quantity of laminae in the sandwich. In some cases no 'tweaking' will be necessary, in other cases it might be done several times in order to properly seat the mold.

Figure 12:
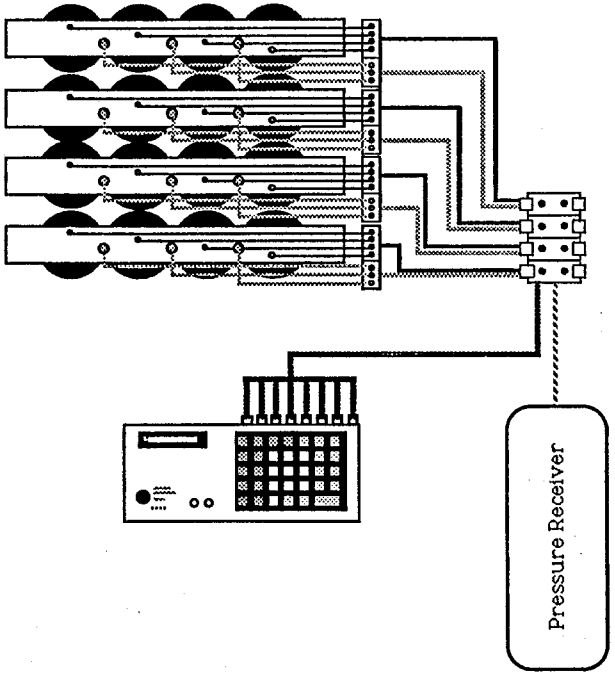
FIG. 12 is a schematic showing the fluid line connections, valves and switches of the present invention.
Figure 11:
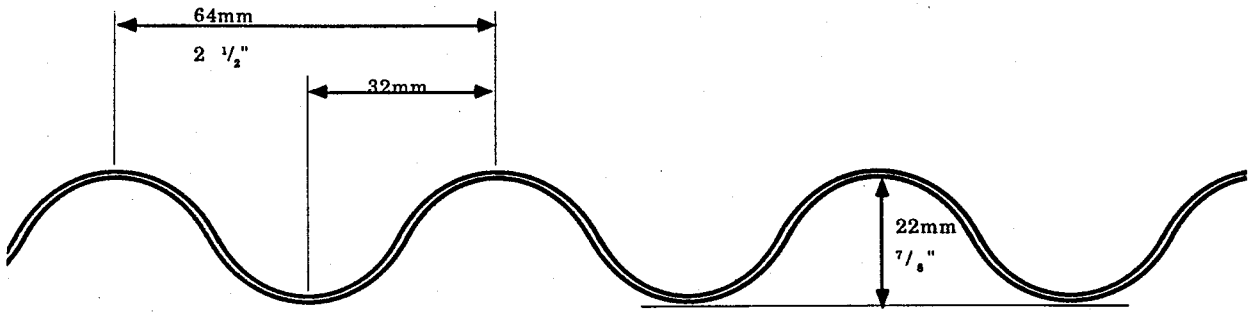
FIG. 11 illustrates a section of the product of the preferred embodiment of the-present invention specifically a corrugated plywood composite, with a core of aramid paper bonded to two faces of wood veneer, dimensions being indicated.

This sequencing is under microprocessor control FIG. 12.

In practice, given the huge variety and thicknesses of veneer or other potential laminae, the choice between pressure application sequences will be chosen after a test run using samples of the particular material to be pressed. The following list is a compilation of our results based on ply thicknesses:

Face Veneer/mils, Back Veneer/mils, Core/mils #, spacers/mils, Sequence:

Mahogony/42, Spruce/50, aramid/15, 1/10 Left to right and Walnut/30: Poplar/45, Aramid/15, 2/20 Left to right and back.

3. Mold Articulation

The use of an upper hinged corrugated mold platen assembly 20 together with 8 in conjunction with a novel press heads (FIG. 4), makes Sequential Articulated Pressure application possible (FIGS. 6,7,8,9 ). As pressure is introduced to the right most press head FIG. 6*d*, its corresponding upper hinged corrugated mold platen assembly 20 together with hinged links 8, starts to descend and compress the sandwich into the mold. The upper corrugated mold platen 20*d* is forced into an angular descent by its left side being restrained by the next press head to its left remaining retracted so that the upper corrugated mold platen; 20*d* pivots around trunnion 9*b*.

To further facilitate the entry of the sandwich into the mold cavity, the upper half of the mold is hinged in a multitude of locations 9*a,b,c*. The hinge placement locations were determined empirically. Though the relationship between the pivot locations and number of corrugations is directly proportional to the ratio of the length of any mold across the corrugations and the amplitude of the corrugation.

Typical Press Cycle:

1. The laminae which are to make up the sandwich are assembled. The number is determined by the thicknesses of the laminae and the available space in the cavity of the mold. A mold with a ¼" gap can mold composite panels up to ¼" thick.

2. The appropriate glue is applied.

3. The laminae sandwich is inserted between the mold halves with veneers overhanging the mold (FIG. 1). Overhanging veneer will be taken up by the contraction of the veneer as it 'corrugates' into the mold cavity.

4. Pressure can be applied in one of several articulated motions. The exact sequencing of these motions are under microprocessor control and switch selectable (FIG. 12).

a. Pressure can begin at the center of the mold and proceed outwards.

b. Pressure can begin on one end and proceed across the mold.

The choice between these two sequences depends upon the type of veneer being utilized as well as its thickness. A determination which can be made with sample runs before a production run.

In addition, each of the two types of motion can be repeated during any single press cycle. The second or third repetition of pressure application will help difficult to bend laminates seat in the mold cavity completely. This may be desirable when exceptionably delicate and/or thick veneers are used.

I claim:

1. The method of manufacturing a corrugated plywood composite comprising the steps of providing a fixed mold member having a corrugated surface, providing a movable mold assembly having a complemental corrugated surface spaced from and in opposition to said fixed corrugated surface, said movable mold assembly being comprised of a plurality of hinged interconnected successive mold sections, interposing between said corrugated surface of said fixed mold member and said movable mold assembly a sandwich disposed between a pair of electrically conductive webs of high tensile strength and low coefficient of friction and comprised of upper and lower layers having an adhesive disposed therebetween, at least one said layer comprising a wood veneer, thereafter clamping said sandwich between said fixed mold member and said mold assembly to cause said sandwich to conform to the configuration of said complemental corrugations, said clamping being effected by sequentially and progressively swinging a side of each successive mold section toward said fixed mold member about the axis of the hinge connecting said section to an adjacent section and thereafter swinging the other side of said section toward said fixed mold member, and thereafter subjecting said sandwich to curing conditions of said adhesive by causing said conductive webs to be heated.

2. The method of claim 1 wherein said webs comprise fluorocarbon impregnated fabric.

3. The method of claim 2 wherein said fabric comprises fiberglass.

4. The method of claim 1 wherein said webs comprise fiberglass.

* * * * *